US007766177B2

(12) United States Patent
Stepp

(10) Patent No.: US 7,766,177 B2
(45) Date of Patent: Aug. 3, 2010

(54) FATIGUE-RESISTANT EMERGENCY RELEASE DEVICE FOR RAIL TRANSIT VEHICLE COUPLER

(75) Inventor: Jerry Lee Stepp, Inman, SC (US)

(73) Assignee: Wabtec Holding Corp., Wilmerding, PA (US)

( * ) Notice: Subject to any disclaimer, the term of this patent is extended or adjusted under 35 U.S.C. 154(b) by 323 days.

(21) Appl. No.: 11/636,344

(22) Filed: Dec. 8, 2006

(65) Prior Publication Data

US 2008/0135511 A1 Jun. 12, 2008

(51) Int. Cl.
*B61G 1/22* (2006.01)

(52) U.S. Cl. ..... 213/7

(58) Field of Classification Search ..... 213/7, 213/40 D, 40 S, 50.5, 62 R, 67 R, 69
See application file for complete search history.

(56) References Cited

U.S. PATENT DOCUMENTS 4,064,998 A 12/1977 Dilg et al.
6,321,922 B1 * 11/2001 Rumsey et al. ..... 213/7
6,499,613 B1 * 12/2002 Grau et al. ..... 213/7
6,981,599 B2 1/2006 Grau et al.

FOREIGN PATENT DOCUMENTS

EP 1 127 769 A2 2/2001
GB 2 257 770 A 1/1993

* cited by examiner

*Primary Examiner*—S. Joseph Morano
*Assistant Examiner*—Robert J McCarry, Jr.
(74) *Attorney, Agent, or Firm*—The Webb Law Firm

(57) ABSTRACT

A release device for a draft gear assembly comprises a draft gear housing for slidably supporting a yoke shaft and capturing a cushion unit associated with the yoke shaft between buff and draft stops. The buff stop comprises a release ring within the interior of the draft gear housing being radially divided into two or more sections. A plurality of release bolts designed to shear under emergency buffing forces extend through the draft gear housing and into the sections of the release ring to draw the sections radially outward to the interior surface of the draft gear housing eliminating gaps and minimizing flexing of the release bolts.

8 Claims, 4 Drawing Sheets

FATIGUE-RESISTANT EMERGENCY RELEASE DEVICE FOR RAIL TRANSIT VEHICLE COUPLER

BACKGROUND OF THE INVENTION

1. Field of the Invention

This invention relates to the mechanical connection between rail vehicles and, in particular, between vehicles for carrying passengers in mass transit applications. This invention more specifically relates to the emergency release of the draft gear or cushioning assembly permitting the vehicles to come together for more controlled absorption of energy and to prevent climbing after collision.

2. Description of Related Art

In railway and transit vehicles, buffing and draft forces between connected vehicles are transmitted to the under frames of the vehicles through drawbars, draft gears and coupler heads (coupler assemblies). The draft gears have cushioning devices which accommodate normally expected forces. Adjacent vehicles are held coupled spaced apart. In the case of abnormal buffing forces which might be encountered on collision, it is desirable to enable the vehicles to come together so that anti-climbers on the ends of the vehicles prevent the end of the trailing vehicle from overriding the lead vehicle. Typically, this function is provided by collapsible draft gears which having release mechanisms based on shear bolts.

As is generally recognized in the railway coupling art, rail transit vehicle coupler assemblies make use of emergency release bolts that break at a designed buff force allowing the draft gear device to telescope into the draft gear housing. The emergency release bolts extend radially through the draft gear housing and into an emergency release ring. The draft gear housing contains an energy-absorbing device that bears against the emergency release ring and emergency release bolts.

The draft gear housing is an integral part of a coupler assembly which is mechanically secured to the underside of its associated vehicle. Coupling and inter-car forces are transmitted from the draft gear assembly to the emergency release ring and to the release bolts by the release ring. Existing coupler assemblies normally employ a rigid emergency release ring suspended in a rigid draft gear housing by radially extending emergency release bolts. A clearance must exist between the rigid emergency release ring and the rigid draft gear housing to permit assembly. The emergency release bolts are designed to shear and break in two pieces when the coupling forces between two vehicles exceed a designed limit as determined by the strength of the emergency release bolts.

Normally, the coupling forces that occur when a consist of rail vehicles is being assembled and connected together for travel with a locomotive or lead vehicle exert less load on the emergency release bolts than the designed limit. The assembly stays intact.

On hard coupling or collision events, forces in excess of the designed limit will be exerted. At this time, the emergency release bolts will break or shear. This allows portions of the draft gear assembly to slide within the draft gear housing and engage a secondary energy dissipation device.

In existing coupler assemblies, the emergency release ring is pulled against the inside wall of the draft gear housing to form a contact at a single location which corresponds to the first emergency release bolt tightened. A gap is formed between the housing and the release ring near the remaining release bolts. This gap allows for forces to repeatedly flex the emergency release bolts in a bending mode. This bending results in reduction in the fatigue strength of the bolts.

The overall structure of the drawbar, draft gear (cushioning unit) and coupler head of one type of mechanical connection for rail vehicles is disclosed in Grau et al. U.S. Pat. No. 6,499,613 entitled "Coupler with Extended Emergency Release and Towing Feature." This patent discloses primary and secondary release devices, the primary release device being most relevant to this application. The structure of a shear bolt and the need of well-defined shear planes are disclosed Grau et al. U.S. Pat. No. 6,981,599 entitled "High Capacity Shear Mechanism."

SUMMARY OF THE INVENTION

It is an object of this invention to provide a fatigue-resistant emergency release device for rail transit vehicle coupler assemblies. Specifically, the release device is provided with enhanced fatigue life performance for emergency release bolts by eliminating bending forces exerted on the emergency release bolts.

Briefly, according to one embodiment of this invention, there is provided a release device for a draft gear assembly. The draft gear assembly comprises a draft gear housing for slidably supporting a yoke and integral yoke shaft and capturing a cushion unit associated with the yoke shaft between buff and draft stops. The buff stop is designed to release from the housing under emergency buffing forces. The buff stop comprises a release ring having a cylindrical axis and an outer cylindrical surface with a diameter permitting sliding engagement within a cylindrical interior surface of the housing. The release ring is radially divided into two or more sections. There are flat chord surfaces parallel to the cylindrical axis on the outer surface of each section. A threaded bore extends into each section through and perpendicular to the flat chord surface in each section.

A retention system holding the sections of the release ring together includes at least one circumferential groove provided in the outer cylindrical surface of the release ring and an expandable split ring positioned in the groove. The retention system allows the independent release ring segments to accommodate radial and longitudinal misalignment of the sections relative to each other.

A plurality of emergency release bolts designed to shear under emergency buffing forces has threaded ends. There is a flat radial bearing surface between the ends of the emergency release bolts. When the release ring is positioned in the draft gear housing, release bolts may extend through the draft gear housing and into the sections of the release ring so that a flat surface extending radially from the release bolt will abut a flat chord surface of a release ring section establishing a well-defined shear plane. Nuts draw the sections radially outward minimizing flexing of the release bolts. The plurality of emergency release bolts directed radially through openings in the draft gear housing and corresponding to threaded holes in the sections of the emergency release ring enable each section to be drawn tightly against the inside surface of the draft gear housing facilitating pure longitudinal shearing load.

Briefly, according to this invention, there is also provided a draft gear assembly comprising a draft gear housing, a yoke and integral yoke shaft slidably secured in a housing, a cushion unit associated with the yoke shaft and captured between buff and draft stops secured in the housing. The buff stop comprises a release ring having a cylindrical axis and an outer cylindrical surface having a diameter permitting sliding engagement within a cylindrical interior surface of the housing. The release ring is radially divided into two or more sections. A threaded bore extends into each section. At least one circumferential groove is provided in the outer cylindrical surface of the release ring. An expandable split ring is positioned in the groove holding the sections of the release ring together.

A plurality of release bolts designed to shear under emergency buffing forces has threaded ends. When the release ring is positioned in the draft gear housing, release bolts may extend through the draft gear housing and into the threaded bore in the sections of the release ring. A nut turned on the other threaded end of the release bolts draws the section radially outward to the interior wall of the draft gear housing eliminating any gap and thus minimizing flexing of the release bolts.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
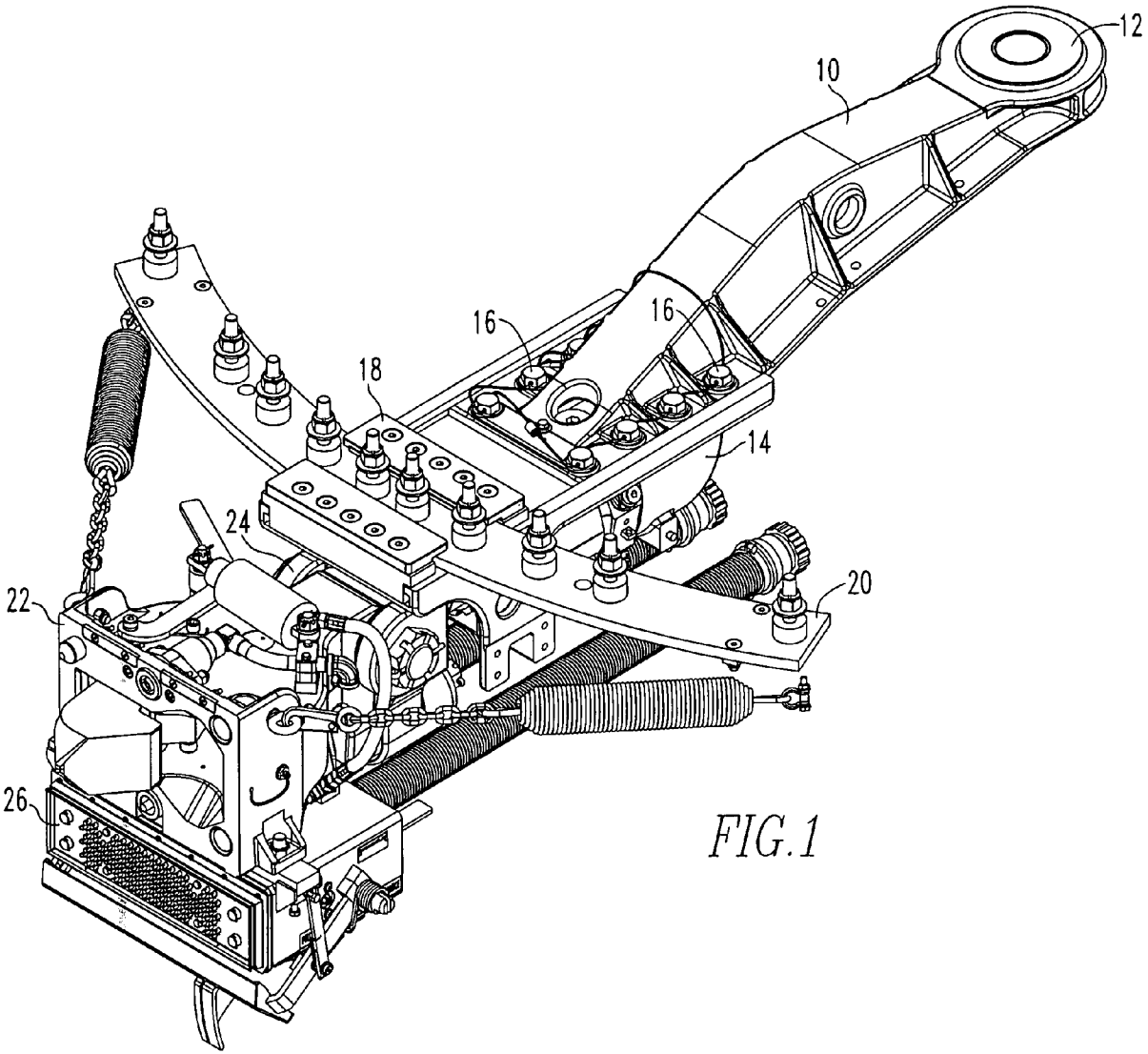
FIG. 1 is a perspective view of drawbar, draft gear and coupler assembly for a modern transit vehicle.

Referring now to FIG. 1, a mechanical connection between transit vehicles comprises a drawbar 10 that is secured to the underside of the vehicle (not shown) by an anchor ring 12 enabling rotation about a generally vertical axis. The draft gear housing 14 is bolted to the drawbar by secondary release bolts 16. On the upper side of the draft gear housing 14, a follower slot 18 is supported to receive a curved guide rail 20 secured to the underside of the vehicle which also accommodates the rotation of the drawbar 10 and draft gear housing 14 about the vertical axis through the anchor ring 12. A coupler head 22 for capturing the coupler head of an adjacent vehicle is mounted to a yoke 24 for rotation about a generally horizontal axis perpendicular to the axis of the drawbar 10. The yoke 24 is integral with a yoke shaft 32 (not visible in FIG. 1) which is journaled in the draft gear housing 14 for some rotation about a horizontal axis parallel to the axis of the drawbar 10. The yoke shaft 32 also moves slidably within the draft gear housing 14. Also shown in FIG. 1 are the electrical coupler 26 and the pneumatic conduits for a brake pipe and reservoir supply pipe. The purpose of FIG. 1 is to illustrate one setting in which the present invention may be found. The multi-segment release ring arrangement which is the subject of the present invention can be used in many drawbars or couplers having draft gear configurations other than those shown in the figures. For example, it has application in light rail type couplers with a tail eye type anchor and integral coupler head.

Figure 2:
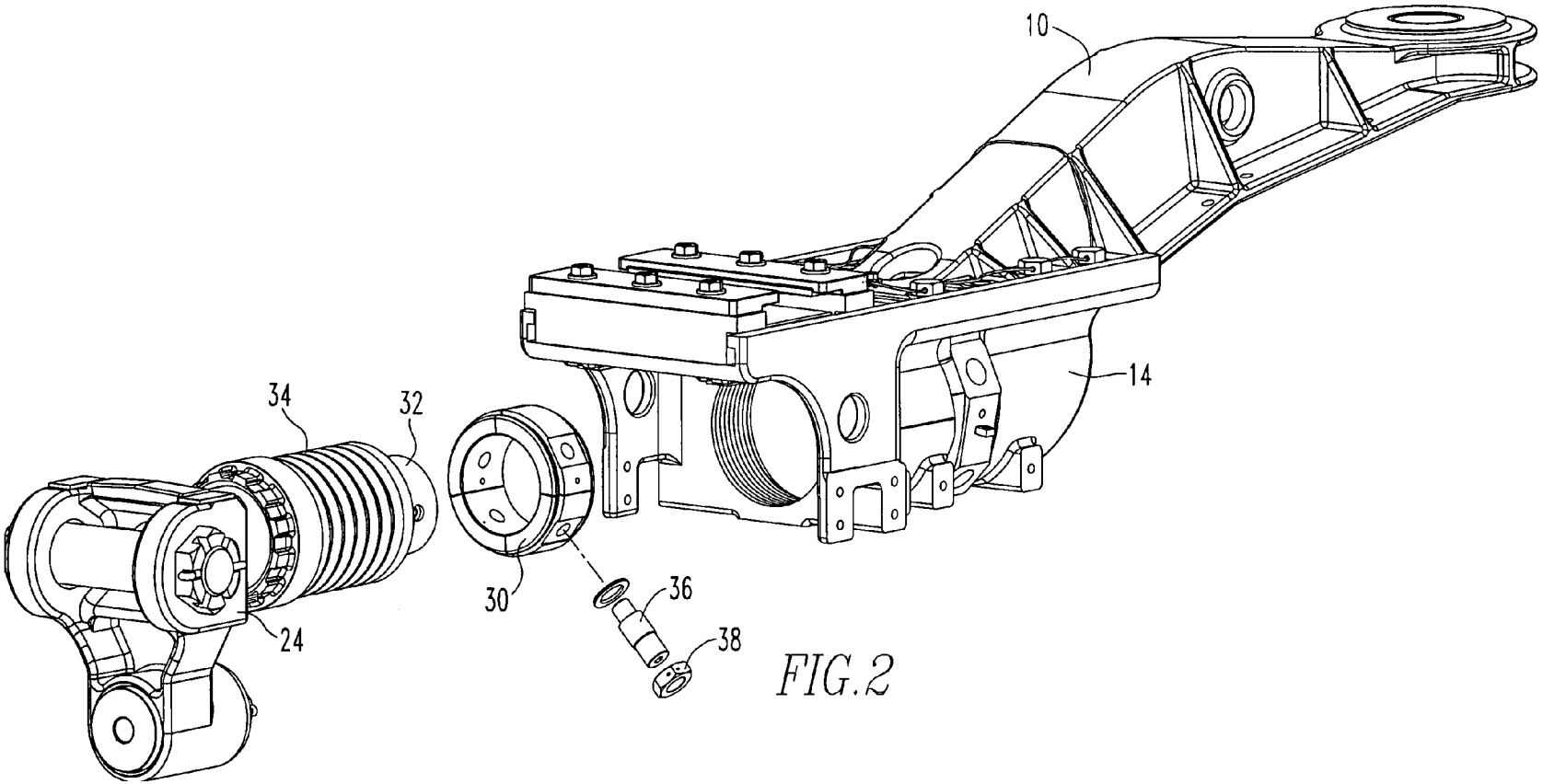
FIG. 2 is an exploded perspective view of a draft gear according to this invention attached to a drawbar.

Referring to FIG. 2, the draft gear housing 14 is shown secured to the drawbar 10. The housing has a hollow generally cylindrical interior. A release ring 30 is shown exploded out of the housing interior as are the yoke 24, yoke shaft 32 and cushioning assembly 34. As shown in FIG. 2, this release ring 30 is a separate and independent member. When these components are slid into the housing, the release ring 30 is secured to the interior wall of the housing by release bolts 36 and nut 38.

Figure 3:
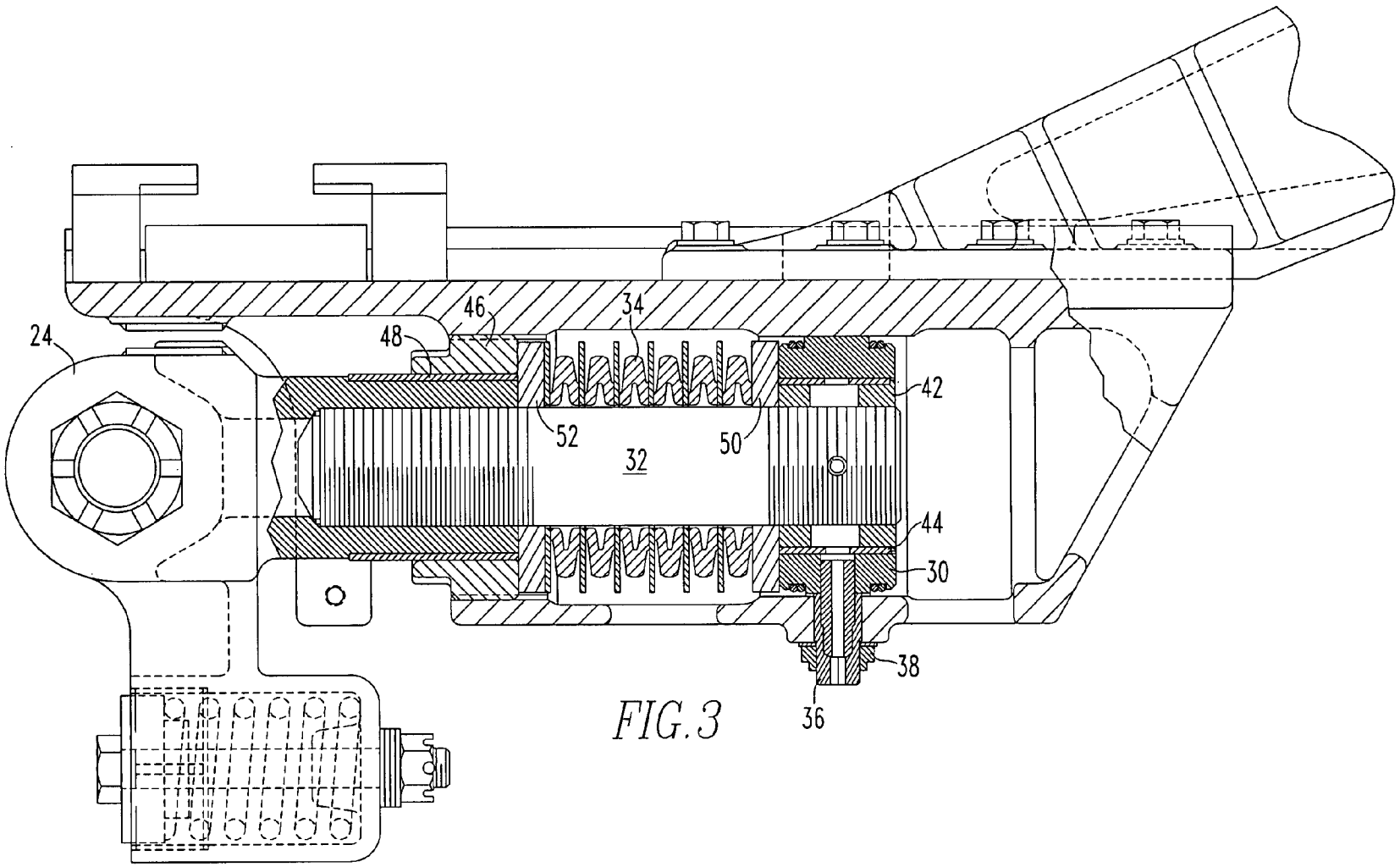
FIG. 3 is a section view of a draft gear according to this invention.

Referring to FIG. 3, the yoke 24 is threadably connected to the yoke shaft 32. At the far end, the yoke shaft 32 is threaded to a tail stud nut 42. The release ring 30 is located radially outward of the tail stud nut 42. The release ring 30 comprises the buff stop. A sleeve bearing 44 is positioned between the release ring 30 and the tail stud nut 42. At the yoke end of the yoke shaft 32, plug nut 46 is threadably secured to the interior of the housing and comprises the draft stop. Sleeve bearing 48 is positioned between the plug nut 46 and the yoke shaft 32. Adjacent the buff and draft stops are followers 50 and 52. Captured between the followers is the cushioning assembly 34. Thus, in normal operation, the yoke shaft 32 can rotate about its axis and can shift in and out of the draft gear housing 14 restricted by the compression of the cushioning assembly 34 against either the buff stop or draft stop.

Figure 4:
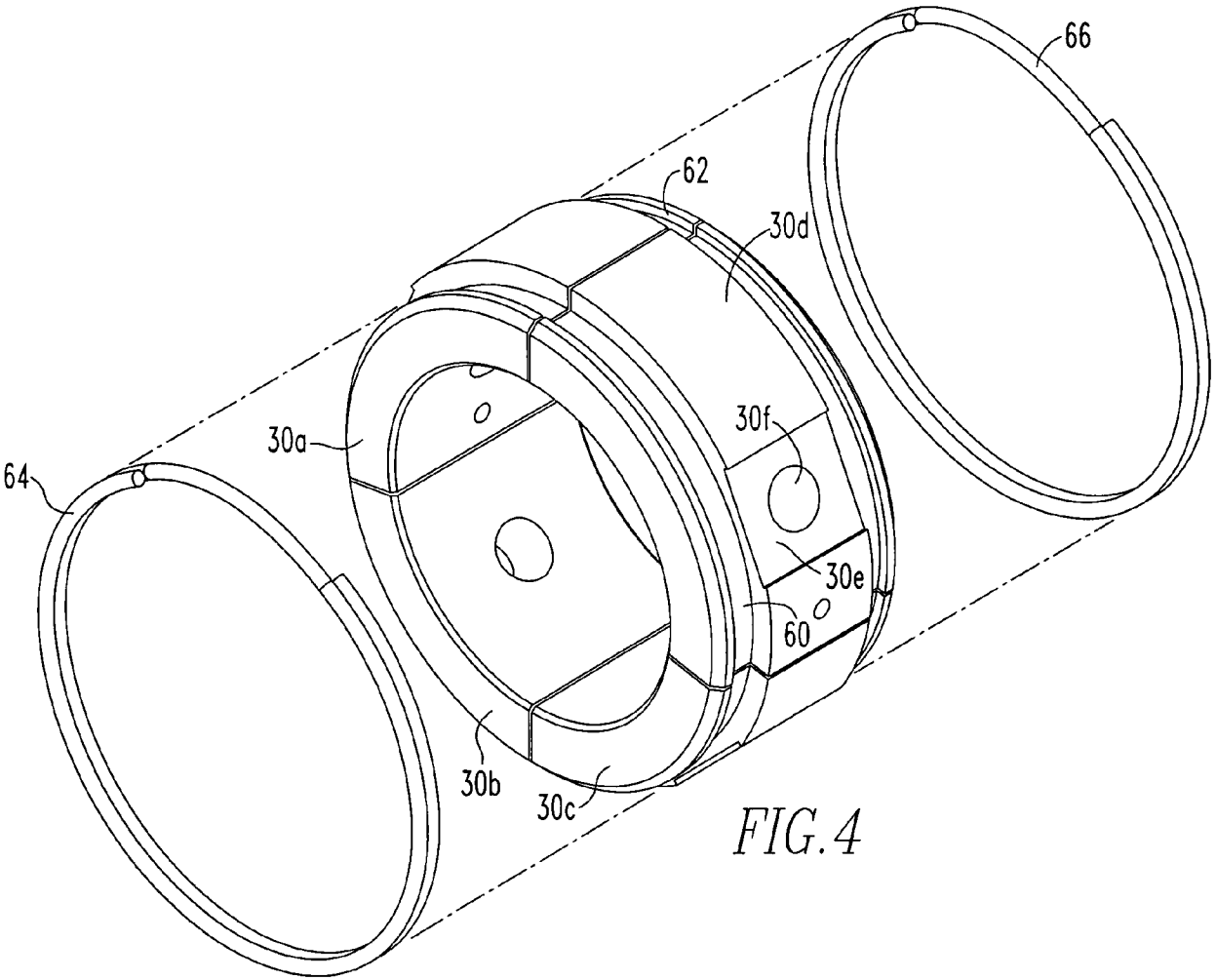
FIG. 4 is an exploded perspective view of a release ring according to this invention.

Referring to FIG. 4, the release ring 30 has a cylindrical axis, an inner circular cylindrical surface and an outer mostly circular cylindrical surface. The ring is divided into four sections 30*a*, 30*b*, 30*c* and 30*d* that are separated by radial planes intersecting the axis of the ring. Each section has on its outer surface a flat chord surface 30*e* and threaded bore 30*f* with an axis perpendicular to the flat chord surface 30*e* for receipt of release bolts 36 (see FIG. 3). The axis of the threaded bore 30*f* intersects the cylindrical axis of the release ring 30.

The release bolts 36 are designed to shear under emergency buffing forces. The release bolts 36 have two threaded ends of different diameters. One threaded end is turned into a threaded bore 30*f* in a release ring section. The other threaded end extends through the draft gear housing 14 and has a torque nut 38 turned thereon. Preferably, a cylindrical shank extends between the threaded ends of the release bolts 36. A flat radial surface is provided where the shank meets the threaded end for turning into a section of the release ring. A preferred release bolt is described in U.S. Pat. No. 6,981,599 noted above.

At each axial end of the release ring circumferential grooves 60, 62 are provided to receive expandable split rings 64, 66. The rings 64, 66 may make several loops and are preferably configured so that each loop of the ring lies on the same cylindrical plane. The split rings 64, 66 when emplaced hold the sections of the release ring 30 together. The expandable split rings 64, 66 provide the sections of the release ring with the ability to expand outward and to move relative to each other in the radial direction.

When the release ring 30 is positioned in the draft gear housing 14, threads on one end of release bolts 36 extend through the draft gear housing 14 and into the sections of the release ring 30 until the flat radial surfaces of the bolts abut the flat chord surfaces 30*e* of the release rings 30. Thereafter, the torque nuts 38 are tightened to draw the sections of the release ring radially outward so that the outer surface of the release sections abut the inner surface of the draft gear housing eliminating any gap and minimizing flexing of the release bolts. The retention system for holding the release ring segments together can take other forms than split rings. Expandable retainers of various types may be applied to the outer diameter, inner diameter or the axial ends of the release ring sections.

It is an advantage of this invention that the multi-segmented release ring can be expanded radially outward to effectively contact the inside of the wall of the draft gear housing adjacent each emergency release bolt, thus eliminating any gap between the inside wall of the draft gear housing and the emergency release ring. This has the effect of equalizing the loads on the emergency release bolts. It also permits the equal preloading of all emergency release bolts at the time of assembly. Most important, this provides a close contact fit between the release ring and the housing at the shear plane eliminating bending forces that can fatigue the release bolts. Finally, the release ring can have an initial (unexpanded) diameter that facilitates in the assembly of the release ring in the draft gear housing.

Having thus described my invention in the detail and particularity required by the Patent Laws, what is desired protected by Letters Patent are set forth in the following claims.

The invention claimed is:

1. A draft gear assembly comprising:

a draft gear housing;

a yoke and integral yoke shaft slidably secured in said housing;

a cushion unit associated with said yoke shaft and captured between buff and draft stops secured in the housing;

the buff stop designed to release from the housing under emergency buffing forces, said buff stop comprising:

a release ring having a cylindrical axis and an outer cylindrical surface having a diameter permitting sliding engagement within a cylindrical interior surface of said draft gear housing, said release ring being radially divided into two or more independent sections, there being a flat chord surface parallel to the cylindrical axis on the outer surface of each section, a threaded bore extending into each section through and perpendicular to the flat chord surface in each section, said release ring being a separate and independent member; and a plurality of release bolts designed to shear under emergency buffing forces having a threaded end and a cylindrical shank with a diameter greater than the external diameter of one threaded end and a flat radial surface where the shank and the one threaded end meet, whereby when the release ring is positioned in the draft gear housing, the release bolts may extend through the draft gear housing and into the sections of the release ring to draw the flat radial surfaces of the bolts into abutment with the flat chord surfaces of the sections and a nut on the other end of the bolts will draw the sections radially outward to the interior surface of the draft gear housing eliminating gaps and minimizing flexing of the release bolts.

2. The draft gear assembly according to claim 1 wherein the yoke shaft slidably moves within the draft gear housing.

3. The draft gear assembly according to claim 1, wherein the release ring is radially divided into at least four sections.

4. The draft gear assembly according to claim 1, having retention means for expandably holding the two or more sections of the release ring together.

5. The draft gear assembly according to claim 4, wherein the retention means comprises an expandable split ring positioned in grooves holding the sections of the release ring together.

6. The draft gear assembly according to claim 5, wherein circumferential grooves are provided at each axial end of the release device and expandable split rings are positioned in each groove such that the rings do not bear on the interior cylindrical surface of the draft gear housing.

7. The draft gear assembly according to claim 5 wherein the expandable split ring allows the sections of the release ring to accommodate radial and longitudinal misalignments of the sections relative to each other.

8. A draft gear assembly comprising:

a draft gear housing;

a yoke and integral yoke shaft slidably secured in said housing;

a cushion unit associated with said yoke shaft and captured between buff and draft stops secured in the housing;

the buff stop designed to release from the housing under emergency buffing forces, said buff stop comprising:

a release ring having a cylindrical axis and an outer cylindrical surface having a diameter permitting sliding engagement within a cylindrical interior surface of said draft gear housing, said release ring being radially divided into two or more independent sections, there being a flat chord surface parallel to the cylindrical axis on the outer surface of each section, a threaded bore extending into each section through and perpendicular to the flat chord surface in each section; and a plurality of release bolts designed to shear under emergency buffing forces having a threaded end and a cylindrical shank with a diameter greater than the external diameter of one threaded end and a flat radial surface where the shank and the one threaded end meet, whereby when the release ring is positioned in the draft gear housing, the release bolts may extend through the draft gear housing and into the sections of the release ring to draw the flat radial surfaces of the bolts into abutment with the flat chord surfaces of the sections and a nut on the other end of the bolts will draw the sections radially outward to the interior surface of the draft gear housing, eliminating gaps and minimizing flexing of the release bolts, and wherein the yoke shaft slidably moves within the draft gear housing, and wherein during normal operation, the yoke shaft can rotate about its axis and can shift in and out of the draft gear housing as restricted by a compression of the cushioning assembly against either the buff stop or the draft stop.

* * * * *